United States Patent [19]

Carrard et al.

[11] 4,070,236

[45] Jan. 24, 1978

[54] PAPER MANUFACTURE WITH IMPROVED RETENTION AGENTS

[75] Inventors: Jean-Pierre Carrard; Helmut Pummer, both of Therwil, Switzerland

[73] Assignee: Sandoz Ltd., Basel, Switzerland

[21] Appl. No.: 630,090

[22] Filed: Nov. 10, 1975

[30] Foreign Application Priority Data

Nov. 15, 1974 Switzerland ..... 15247/74
Nov. 19, 1974 Switzerland ..... 15370/74

[51] Int. Cl.[2] ..... D21D 3/00

[52] U.S. Cl. ..... 162/164 R; 162/165; 162/168 R

[58] Field of Search ..... 162/165, 168 R, 164 R; 260/49

[56] References Cited

U.S. PATENT DOCUMENTS

| | | | |
|---|---|---|---|
| 2,357,798 | 9/1944 | Niederhauser et al. | 260/49 |
| 2,411,557 | 11/1946 | Schuh | 162/165 |
| 2,785,975 | 3/1957 | Sheeran | 162/165 |
| 3,062,699 | 11/1962 | Raphael et al. | 162/165 |
| 3,141,815 | 7/1964 | Manley | 162/164 R |
| 3,219,607 | 11/1965 | Perronin | 260/49 |
| 3,230,198 | 1/1966 | Meyers | 260/49 |
| 3,281,312 | 10/1966 | Fetters et al. | 162/168 R |

FOREIGN PATENT DOCUMENTS

| | | | |
|---|---|---|---|
| 557,236 | 5/1958 | Canada | 162/165 |

*Primary Examiner*—Robert L. Lindsay, Jr.
*Assistant Examiner*—Peter Chin
*Attorney, Agent, or Firm*—Gerald D. Sharkin; Richard E. Vila; Thomas C. Doyle

[57] ABSTRACT

Disclosed is a process for the production of paper and paper-like products which comprises the step of incorporating in the pulp a retention agent comprising a polyalkylene oxide of molecular weight in excess of 1 million and a phenol- or naphthol-formaldehyde or -sulphur resin.

9 Claims, No Drawings

PAPER MANUFACTURE WITH IMPROVED RETENTION AGENTS

The invention relates to the production of paper and paper-like products, such as cardboard, pasteboard and the like, produced from a pulp mass by extraction of water.

Thus, the invention provides a process for the production of paper and paper-like products which comprises the step of incorporating in the pulp a retention agent comprising a polyalkylene oxide of molecular weight in excess of 1 million and a phenol- or naphthol-formaldehyde or -sulphur resin.

The polyalkylene oxides employed in the process of the invention preferably have a molecular weight of from about 4 to 7 million. They may, for example, be polyethylene oxides, polypropylene oxides and co-condensed polyethylene/polypropylene oxides. The preferred polyalkylene oxides are, however, the polyethylene oxides. The polyalkylene oxide is preferably employed in the process of the invention in an amount of from 0.001 to 0.05% by weight of the solids in the pulp.

The preferred phenol- or naphthol- formaldehyde and phenol-or naphthol-sulphur resins are the water-soluble such resins.

The phenol-or naphthol-formaldehyde resins are preferably those which are useful as synthetic tanning agents for leather, e.g. those sold under the names "Basyntans," "Tanigans," "Tanicors" and "Irgatans." They are also known as dyeing acids, e.g. as sold under the name "Nylofixan." The especially preferred phenol- and naphthol-formaldehyde resins are those containing sulphonic acid and/or sulphone groups and, as will be appreciated, may be heteropolymers containing units other than the phenol, naphthol and formaldehyde units, particularly preferred resins being water soluble resins formed by condensation of formaldehyde with m-xylene sulphonic acid and dihydroxydiphenylsulphone.

For a general description of the nature and production of water-soluble phenol-and naphthol-formaldehyde resins reference is made to Stather "Gerbereichemie and Gerbereitechnologie" Akademieverlag, Berlin 1967, pp. 353–367.

The phenol- and naphthol-sulphur resins used according to the invention are known, e.g. from German Pat. Specification No. 562.503 and may be produced by heating phenols with sulphur and alkalis in the presence of metals and metal compounds of the type which are precipitated by ammonium or hydrogensulphide, e.g. molybdenum, antimony, arsenic, aluminium, manganese, zinc, tin and their compounds. The phenyl and naphthyl nuclei, as is the case also in the phenyl- and naphthol-formaldehyde resins, may be additionally substituted, e.g. by chlorine, sulpho, carboxy and further hydroxy groups.

The phenol- and naphthol-sulphur resins employed in the invention have long been used commercially as reserving agents, especially for dyeing wool with acid dyes, and as tanning agents.

The phenol/naphthol-formaldehyde and -sulphur resins are preferably employed in the process of the invention in an amount of from 0.01 to 0.5% based on the solids weight in the pulp, and the weight ratio of such resins to the polyalkylene oxide is suitably from 5:1 to 500:1, preferably from 10:1 to 100:1. The phenol- and naphthol-formaldehyde and -sulphur resins may be incorporated in the pulp separately from or together with the polyalkylene oxide.

If desired, the retention agent used in the process of the invention may be employed in conjunction with other retention agents, e.g. of the known polyamide amine, polyalkylene, e.g. polyethylene, imine, polyamine and polyacrylic amide types.

The action of retention agent employed in the present invention is largely unaffected by water-glass (used for stabilising peroxides employed in bleaching wood pulp) ligninan, industrial water containing humic acid and many other substances present in wood pulp. They are also largely unaffected by pH and aluminium sulphate and give papers and paper-like products with a relatively even distribution of addititives, e.g. pigments, fillers etc., throughout the cross-section thereof (i.e. alleviation of the so-called "two-sided" effects) as well as substantially hindering the leaching of such additives from the paper pulp during the water extraction and roller stages and thereby alleviating waste water-disposal problems.

The invention is illustrated by the following Examples in which all parts and percentages, unless otherwise stated, are by weight, and all temperatures are in degrees centigrade.

EXAMPLE 1

A 2% paper pulp consisting of bleached sulphite cellulose (35° SR) which contains 16% filler (kaolin Grade A) and sized with 2% rosin size and 3% Al sulphate is prepared. Before sheet formation on the Rapid-Kothen sheet former, 250 parts of a testing sample are removed from the testing stock and 0.2% (in relation to solids content) of commercial 30% "Nylofixan P" (a phenol-formaldehyde resin of m-xylenesulphonic acid, dihydroxydiphenyl sulphone and formaldehyde) in diluted solution is added to the paper pulp. After stirring for 5 seconds at 250 rev/min, it is further diluted with 750 parts of water in which is contained a commercial high-molecular weight polyethylene oxide (m.w. = 4,000,000) (Polyox WSR 301) in an amount of 0.01% (in relation to solids). After further stirring for 5 seconds at 250 re 250 rev/min, the above mixture is transferred to the filling chamber of a sheet former (Rapid Kothen system), whereby 3000 parts of water are already present in the filling chamber of the sheet former. In order to make the test difficult, stirring takes place in the filling chamber of the sheet former for 30 seconds at 500 rev/min before the sheet is formed after a further waiting time of 20 seconds. A further sheet was formed in identical manner to as above except that no phenol-formaldehyde resin was added. After drying and conditioning of the two test sheets, they are incinerated. The ash weights are related to the amount of filler retained and the % retention calculated. The results show that compared with using only "Polyox," a considerable improvement is obtained in the retention effect by adding the phenolformaldehyde resin to "Polyox" WSR 301.

EXAMPLE 2

5% water-glass, 2.5% of sulphite waste liquor (techn.) or 1% of humic acid (techn.) are added to a paper pulp having 2% density and a final grinding degree of 50° SR, consisting of 70% mechanical wood pulp (bleached), 30% sulphite pulp and 15% kaolin in relation to the fibrous material.

The dehydration and turbidity values are determined from the prepared samples by adding 0.2 or 0.4% of various polyelectrolytes in relation to the paper pulp (see below). The turbidity of the filtrate obtained in the dehydration test is ascertained in the light transmission process using a spectrophotometer at 460 nm and with a cell diameter of 1 cm (the apparatus is gauged to distilled water = 100).

One requirement for the dehydration effect is the time taken for a certain amount of filtrate to pass out of a suspension containing a dehydration agent and having a certain paper pulp composition, compared with the time taken for a corresponding amount of filtrate to pass out of a suspension free of aids.

The testing method used is described in pamphlet V/7/61 of the "Vereins der Zellstoff- und Papier-Chemiker und -Ingenieur."

The following polyelectrolytes are used for testing:

1. "Cartaretin F" (polyamide amine 30% TS) (for comparison);
2. "Separan CP 35" (cat. polyacrylamide 5% TS) (for comparison);
3. "Cartaretin F" + "Polyox WSR 301" (in the ratio of 12.5 parts of Cartaretin F to 1 part "Polyox WSR 301");
4. Combination according to the invention: addition of 1 part "Nylofixan P" to the paper pulp 5 seconds before adding 4 parts of mixture 3.
5. Combination according to the invention: addition of 0.5 parts phenol-sulphur resin to the paper pulp 5 seconds before adding 4 parts of mixture 3.

The results of the tests show a considerable improvement in the dehydration time and retention effect when using the combination according to the invention, as compared with the polyelectrolytes nos. 1, 2 and 3.

EXAMPLE 3

A 2% paper pulp consisting of bleached sulphite pulp containing 16% filler is prepared.

After mixing well, 250 parts are removed from this pulp suspension.

These 250 parts of suspension are placed in a V 2A beaker (2000 parts capacity) and they are stirred. The stirrer head is adjusted so that the stirrer blade lies 2–5 mm above the metal base of the beaker in the rest position. A funnel containing 750 parts of water and retention agent in the concentration given below is placed so that its outlet tube is directed towards the middle of the metal beaker. The activating agent is 0.2% of a commercial fixation agent based on a condensation product of phenol and sulphur, aided by $SnCl_4/SbCl_3$ according to German Patent 562 502. Before adding 0.02% of polyethylene oxide (m.w. > 4 million) ("Polyox WSR 301"), the stirrer motor is activated at a pre-selected speed of 250 rev/min. After 5 seconds (all measurements with a stop watch) the rod stopper of the funnel is raised and the above-mentioned retention agent "Polyox WSR 301" which is diluted to at least 1:100 is added. After 10 seconds, the speed of revolution of the stirrer motor is selectively increased to 500 and 100 rev/min.

After stirring for 60 seconds, the stirrer motor is stopped; after a further 10 seconds, the suspension is poured over the course of 2 seconds into the filling chamber of a Schopper-Riegler apparatus (whose middle axis is closed by a rubber stopper).

After 100 seconds, the catch for lifting off the sealing cone is released and the stop-watch is put back to nil seconds. Using a second stop-watch, the time for 700 ml of filtrate to flow out through the side outlet after removing the sealing cone is determined.

Turbidity measurements are made on the filtrate obtained using a spectrophotometer at 460 nm.

When comparing the dehydration and retention results obtained under the influence of higher stirring speeds with those obtained using commercial polyacrylamides, it can be seen that using the combination according to the invention, there is improved independence of cutting with higher cutting loads.

EXAMPLE 4 a. 5 parts of polyethylene oxide (PEO) (m.w. ~ 7 000 000) are pre-dispersed in 15 parts of ethylene glycol. Then, 330 parts of water are added and the PEO is dissolved therein.
b. 5 parts of polyethylene oxide (PEO) (m.w. ~ 7 000 000) are pre-dispersed in 15 parts of ethylene glycol. Then, 295 parts of water in which are dissolved 35 parts of "Cartaretin F" (30% polyamideamine) are added and the PEO is dissolved therein.

A paper pulp according to example 1 is prepared. From this pulp the dehydration values are determined when 0.5% (in relation to dry paper pulp) of the above-mentioned types a) and b) is added, together with various amounts of Alsulphate (0, 1, 2 or 3%) and a constant addition of polyelectrolyte. A feed of a commercial fixation agent based on a condensation product of phenol and sulphur, aided by $SnCl_4/SbCl_3$ according to German Pat. No. 562 502.

250 parts of paper pulp are used. These 250 parts are emptied into a V 2A beaker which holds 2000 parts and this is put on the stirrer. The stirrer head is adjusted so that the stirring blade lies 2–5 mm above the metal base of the beaker in the rest position. The funnel containing the prepared 750 ml of water + dehydration agent solution is placed such that its outlet tube is directed towards the middle of the metal beaker.

Simultaneously with the transfer with a pipet of 0.125% of a commercial fixation agent based on a condensation product of phenol and sulphur, aided by $SnCl_4/SbCl_3$ according to German Patent 562 502, the stirrer motor is motivated at a speed of 250 rev/min. After 5 seconds, the rod stopper of the funnel is raised and the retention agent solution (0.5% in relation to the fibrous material) — diluted to at least 1:100 — is added.

After a further 5 seconds, the motor is stopped and the pulp suspension is transferred into the filling chamber of the Schopper-Riegler apparatus (whose middle axis is closed by a rubber stopper). After a further 8–10 seconds, the catch for removing the sealing cone of the Schopper-Riegler apparatus is activated and a stop-watch is simultaneously started.

The time required for 700 ml of filtrate to flow out through the side outlet after removing the sealing cone is determined.

From the results, it can be seen clearly that the joint use of polyethylene oxide and polyamide amine in the process according to the invention, especially in the application without Al-sulphate, allows better dehydration times, than when the high-molecular weight polyethylene oxide is used alone. The range of use is increased through the joint use with polyamide amine.

What is claimed is:

1. A process for the production of paper and paper-like products which comprises the step of incorporating in the pulp a retention agent comprising a polyalkylene oxide of molecular weight in excess of 1 million and a water soluble resin selected from the group consisting of phenol - or naphthol formaldehyde containing sulfonic acid and/or sulfone groups and phenol - or naphthol sulfur resin, said resin being employed in an amount of from 0.01 to 0.5% by weight based on the weight of solids in said pulp.

2. A process according to claim 1, wherein said polyalkylene oxide has a molecular weight of from 4 to 7 million.

3. A process according to claim 1, wherein said polyalkylene oxide is employed in an amount of from 0.001 to 0.05% by weight based on the weight of solids in the pulp.

4. A process according to claim 1, wherein said polyalkylene oxide is polyethylene oxide.

5. A process according to claim 1, wherein said resin is a phenol- or naphthol-formaldehyde resin containing sulphonic acid and/or sulphone groups.

6. A process according to claim 1, wherein said resin is a condensation product of formaldehyde with m-xylene sulphonic acid and dihydroxydiphenylsulphone.

7. A process according to claim 1, wherein the weight ratio of the phenol- or naphthol-formaldehyde or -sulphur resin to the polyalkylene oxide is from 5:1 to 500:1.

8. A process according to claim 7, wherein said ratio is from 10:1 to 100:1.

9. A process according to claim 1, wherein the retention agent is employed in conjunction with a retention agent of the polyamide amine, polyalkylene imine, polyamine or polyacrylic amide type.

* * * * *